US009920401B2

(12) United States Patent
Seo et al.

(10) Patent No.: US 9,920,401 B2
(45) Date of Patent: Mar. 20, 2018

(54) ALUMINUM BASE ALLOY WITH HIGH THERMAL CONDUCTIVITY FOR DIE CASTING

(75) Inventors: Ho Sung Seo, Seoul (KR); Gi Dong Kang, Gyeonggi-do (KR)

(73) Assignee: SANGMOON, Gyeonggi-do (KR)

( * ) Notice: Subject to any disclaimer, the term of this patent is extended or adjusted under 35 U.S.C. 154(b) by 866 days.

(21) Appl. No.: 13/391,156

(22) PCT Filed: Jul. 14, 2010

(86) PCT No.: PCT/KR2010/004569
§ 371 (c)(1),
(2), (4) Date: Feb. 17, 2012

(87) PCT Pub. No.: WO2011/021777
PCT Pub. Date: Feb. 24, 2011

(65) Prior Publication Data

US 2012/0275949 A1 Nov. 1, 2012

(30) Foreign Application Priority Data

Aug. 19, 2009 (KR) ..... 10-2009-0076595

(51) Int. Cl.
*C22C 21/06* (2006.01)
*C22C 21/00* (2006.01)

(52) U.S. Cl.
CPC ..... *C22C 21/06* (2013.01); *C22C 21/00* (2013.01)

(58) Field of Classification Search
CPC ..... C22C 21/06
USPC ..... 420/550, 551, 547, 543
See application file for complete search history.

(56) References Cited

U.S. PATENT DOCUMENTS 2,885,286 A * 5/1959 Weber ..... 420/533
3,920,411 A * 11/1975 Schoerner et al. ..... 420/550

FOREIGN PATENT DOCUMENTS

| | | |
|---|---|---|
| JP | 59-043839 | 3/1984 |
| JP | 2002-241877 | 8/2002 |
| JP | 2004-269971 | 9/2004 |
| JP | 4038230 | 1/2008 |

* cited by examiner

*Primary Examiner* — Roy King
*Assistant Examiner* — Janelle Morillo
(74) *Attorney, Agent, or Firm* — IP & T Group LLP

(57) ABSTRACT

The present invention relates to an aluminum base alloy with high thermal conductivity, and more particularly, to an alloy for die casting that does not become brittle and has high thermal conductivity, so as to be easily used for LED lighting parts, and contains 0.2 to 2.0 wt % of Mg, 0.1 to 0.3 wt % of Fe, 0.1 to 1.0 wt % of Co, with the remainder being Al.

3 Claims, 2 Drawing Sheets

Thermal Diffusivity - NETZSCH LFA Analysis

*General information*

| | | | |
|---|---|---|---|
| Database : | 090804.mdb | Operator : | Kim S. K. |
| Instrument : | LFA 447 | Remark(comment) : | KAIST |
| Identity : | 21612850 09.08.04 | Cp table : | KSK Cp SM-SKT |
| Date : | 8/4/2009 | Expansion table : | dL_const |
| Material : | SM-SKT | Furnace : | NanoFlash 300 |
| Sample : | SM-SKT | Sample holder : | NanoFlash 12.7rd |
| Type : | Single layer | Laser : | Xenon NanoFlash |
| Thickness (RT) (mm) : | 2.0850 | Furnace TC : | S |
| Diameter (mm) : | 12.700 | Sample TC : | S |
| Sensor : | InSb | | |

*Results*

| Shot number | Temperature °C | Model | Diffusivity mm^2/s | Conductivity W/(m·K) | Cp J/g·K | Pulse type |
|---|---|---|---|---|---|---|
| 1 | 25.000 | Capel. + pc. | 81.320 | 194.169 | 0.885 | 2 (medium) |
| 2 | 25.000 | Capel. + pc. | 81.572 | 194.770 | 0.885 | 2 (medium) |
| 3 | 25.000 | Capel. + pc. | 81.301 | 194.123 | 0.885 | 2 (medium) |
| Mean: | 25.000 | | 81.398 | 194.354 | 0.885 | |
| Std. Dev.: | 0.000 | | 0.151 | 0.361 | 0.000 | |

Density : 2.699 g/cm3

[FIG. 1]

Thermal Diffusivity - NETZSCH LFA Analysis

*General information*

| | | | |
|---|---|---|---|
| Database : | 090804.mdb | Operator : | Kim S. K. |
| Instrument : | LFA 447 | Remark(mment) : | KAIST |
| Identity : | 21612850 09.08.04 | Cp table : | KSK Cp SM-SKT |
| Date : | 8/4/2009 | Expansion table : | dL_const |
| Material : | SM-SKT | Furnace : | NanoFlash 300 |
| Sample : | SM-SKT | Sample holder : | NanoFlash 12.7rd |
| Type : | Single layer | Laser : | Xenon NanoFlash |
| Thickness (RT) mm : | 2.0850 | Furnace TC : | S |
| Diameter mm : | 12.700 | Sample TC : | S |
| Sensor : | InSb | | |

*Results*

| Shot number | Temperature °C | Model | Diffusivity mm^2/s | Conductivity W/(m·K) | Cp J/g·K | Pulse type |
|---|---|---|---|---|---|---|
| 1 | 25.000 | CapeL + pc. | 81.320 | 194.169 | 0.885 | 2 (medium) |
| 2 | 25.000 | CapeL + pc. | 81.572 | 194.770 | 0.885 | 2 (medium) |
| 3 | 25.000 | CapeL + pc. | 81.301 | 194.123 | 0.885 | 2 (medium) |
| **Mean:** | **25.000** | | **81.398** | **194.354** | **0.885** | |
| **Std. Dev.:** | **0.000** | | **0.151** | **0.361** | **0.000** | |

Density : 2.699 g/cm3

[FIG. 2]

Thermal Diffusivity - NETZSCH LFA Analysis

*General information*

| | | | |
|---|---|---|---|
| Database : | 090804.mdb | Operator : | Kim S. K |
| Instrument : | LFA 447 | Remark(mment) : | KAIST |
| Identity : | 21613840 09.08.04 | Cp table : | KSK Cp SM-6063 |
| Date : | 8/4/2009 | Expansion table : | dL_const |
| Material : | SM-6063 | Furnace : | NanoFlash 300 |
| Sample : | SM-6063 | Sample holder : | NanoFlash 12.7rd |
| Type : | Single layer | Laser : | Xenon NanoFlash |
| Thickness (RT) mm : | 2.0790 | Furnace TC : | S |
| Diameter mm : | 12.700 | Sample TC : | S |
| Sensor : | InSb | | |

*Results*

| Shot number | Temperature °C | Model | Diffusivity mm^2/s | Conductivity W/m/K | Cp J/g/K | Pulse type |
|---|---|---|---|---|---|---|
| 1 | 25.000 | CapeL + pc. | 78.909 | 192.672 | 0.907 | 2 (medium) |
| 2 | 25.000 | CapeL + pc. | 79.040 | 192.993 | 0.907 | 2 (medium) |
| 3 | 25.000 | CapeL + pc. | 78.923 | 192.707 | 0.907 | 2 (medium) |
| Mean: | 25.000 | | 78.957 | 192.791 | 0.907 | |
| Std. Dev.: | 0.000 | | 0.072 | 0.176 | 0.000 | |

Density : 2.692 g/cm3

ALUMINUM BASE ALLOY WITH HIGH THERMAL CONDUCTIVITY FOR DIE CASTING

This application is a national stage application of PCT/KR2010/004569 filed on Jul. 14, 2010, which claims priority of Korean patent application number 10-2009-0076595 filed on Aug. 19, 2009. The disclosure of each of the foregoing applications is incorporated herein by reference in its entirety.

TECHNICAL FIELD

The present invention relates to an aluminum base alloy with high thermal conductivity, and more particularly, to an alloy for die casting that does not become brittle and has high thermal conductivity, so as to be easily used for LED lighting parts, and contains 0.2 to 2.0 wt % of Mg, 0.1 to 0.3 wt % of Fe, 0.1 to 1.0 wt % of Co, with the remainder being Al.

BACKGROUND ART

In the manufacturing industry, iron materials have been gradually replaced by lightweight materials such as aluminum and the like. The necessity for lightweight materials has culminated in the development of an aluminum alloy that can form a structure withstanding the stress corresponding to that of a structure formed of iron materials. Such an aluminum alloy must be able to have corrosion resistance, be die-cast and be easily machined as well as have high yield strength and high elongation.

Historically, a cast aluminum alloy has been characterized by having low strength and ductility compared to a forged product having a composition similar to that of the cast aluminum alloy. The reason why the cast aluminum alloy has low strength and ductility is because the cast aluminum alloy has defects that are generally removed by machining the forged aluminum alloy. Such effects are classified into two types, that is, pores caused by contraction or gas storage and large breakable particles caused by the intermetallic phase formed by oxides or impurities trapped in a cast product. High-quality cast products result from developing casting technologies for minimizing the number and size of such defects or changing the composition of aluminum alloy.

The highest-quality cast aluminum alloy is aluminum-silicon-magnesium (Al—Si—Mg) alloy. The strength and ductility of an aluminum alloy can be generally improved by maintaining aluminum alloy clean or using high-purity components (reforming AlSiFe 5 by increasing the content of iron (Fe) and/or by adding beryllium (Be)). As a result, currently, the properties of aluminum cast products are approaching those of aluminum forged products having the same composition as the aluminum cast product.

However, with the development of industry, aluminum alloys having improved mechanical properties have been required, and thus aluminum alloys having high thermal conductivity for die casting have also been required.

Most commercially available aluminum alloys for die casting are complex alloys each including several alloys and impurity elements. Due to the elements included in the complex alloy, the variable concentration thereof and the interaction therebetween, systematic research into the effect of the elements on commercially available aluminum alloys is complicated and difficult.

Although it is difficult to explain the effect of each element on the mechanical properties of aluminum alloys, it is recognized by those skilled in the art that the properties of aluminum alloys are influenced by magnesium, manganese, iron, silicon and beryllium as follows.

Magnesium is generally used to improve the tensile strength of aluminum alloy. A binary alloy of Al—Mg has high strength, excellent corrosion resistance, excellent weldability and excellent surface finishability. However, when the content of magnesium is increased, the hardness and fatigue endurance of aluminum alloy can be improved, but the ductility of aluminum alloy may be decreased. The reason why the content of magnesium in aluminum alloy is limited is because magnesium is easily oxidized to form magnesium oxide (MgO) particles in the molten aluminum alloy. That is, spinel, which is a complicated aluminum magnesium oxide, is formed at high temperature (750° C. or more), and thus an inclusion is formed in the molten aluminum alloy and rapidly grows. Such an inclusion decreases the fluidity and elongation of the aluminum alloy.

Copper (Cu) may also be added to the aluminum alloy in order to increase the strength and thermal conductivity of the aluminum alloy. When the content of copper is increased, the hardness and thermal conductivity of the aluminum alloy are increased, but the strength and ductility thereof depend on whether or not copper (Cu) is present in a solid solution or exists in the form of spheroidal or uniformly-applied particles. Copper (Cu) decreases electrolytic potential and corrosion resistance. The aluminum alloy containing copper is greatly spotted and corroded when it is annealed, and may be interparticle-corroded or stress-corroded even when it is aged and cured.

Silicon (Si) is an important component for improving the fluidity of molten aluminum alloy during a die casting process. An Al—Si alloy has good high-temperature tear resistance, steadiness and weldability because it has low contractility and a narrow freezing point range. In an Al—Mg alloy, silicon (Si) increases ductility and extensibility without increasing strength. Further, in an Al—Cu—Si alloy, a combination of copper and silicon greatly increases hardness, but greatly decreases extensibility.

Iron (Fe) is generally added to a die casting aluminum alloy in order to prevent the aluminum alloy from becoming attached to the die and to easily detach the aluminum alloy from the die. However, the extensibility of the aluminum ally is decreased by the addition of iron (Fe). In order to solve the problem, manganese (Mn) is added to the aluminum alloy. However, when an excessive amount of manganese (Mn) is added, the mechanical strength of the aluminum alloy may be lowered.

A LED bulb, which has lately been developed and used, must have a body structure for radiating the heat emitted therefrom. However, currently, commercially-available die casting materials include ADC12 (LM2), ADC1 (LM6), B390 and DM3H. Here, ADC12 (LM2) has a thermal conductivity of 100 W/mk, ADC1 (LM6) has a thermal conductivity of 142 W/mk, B390 has a thermal conductivity of 134 W/mk, and DM3H has a thermal conductivity of 114 W/mk.

DM3H is an anodizable material, but has a low thermal conductivity of 114 W/mk. Further, ADC12 is a die casting material having good mass productivity, but has a low thermal conductivity of 100 W/mk.

Meanwhile, 6063 is a material having the highest thermal conductivity, is a magnesium (Mg) alloy, and is used as a heat sink. Although 6063 has a high thermal conductivity of 190~200 W/mk, it can be die-cast because it easily breaks.

It is not easy to obtain a material which has high thermal conductivity and can also be die-cast. Therefore, it is difficult to obtain a material suitable for a product such as LED or the like which is manufactured by die casting and which must radiate heat.

DISCLOSURE

Technical Problem

An object of the present invention is to provide an aluminum base alloy which has high thermal conductivity next to that of the 6063 material, which can be die-cast and which can be anodized.

Technical Solution

In order to accomplish the above object, an aspect of the present invention provides an aluminum base alloy having high thermal conductivity for die casting, including: 0.2 to 2.0 wt % of Mg, 0.1 to 0.3 wt % of Fe, 0.1 to 1.0 wt % of Co, and residual Al, wherein the aluminum base alloy further includes 0.05 to 0.2 wt % of Ti or further includes 0.05 to 0.2 wt % of Ag.

Advantageous Effects

As described above, the thermal conductivity of the aluminum base alloy of the present invention is superior to that of the 6063 material, and is improved by 50~90% over that of the ADC12 that is a material for die casting. Therefore, the aluminum base alloy of the present invention can be anodized, and can have excellent machinability and high thermal conductivity.

DESCRIPTION OF DRAWINGS

FIG. 1 is a Table showing the data of thermal conductivity measurements of the aluminum base alloy according to an embodiment of the present invention.

FIG. 2 is a Table showing the data of thermal conductivity measurements of the conventional 6063 material that cannot be die-cast.

MODE FOR INVENTION

Hereinafter, the present invention will be described in detail with reference to the accompanying drawings.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe the best method he or she knows for carrying out the invention.

The present invention provides an aluminum base alloy which has high thermal conductivity and can be die-cast.

The aluminum base alloy of the present invention includes 0.2 to 2.0 wt % of Mg, 0.1 to 0.3 wt % of Fe, 0.1 to 1.0 wt % of Co and residual Al, based on 100% of the total weight thereof.

According to an embodiment of the present invention, for thermal conductivity experiments, an aluminum base alloy having a composition including Mg 0.6 wt %, Fe 0.15 wt %, Co 0.4 wt % and Al 98.85 wt % was prepared, and a very small amount of impurities, such as Si 0.038 wt %, Cu 0.001 wt %, Mn 0.0015 wt %, Zn 0.003 wt %, Ni 0.0075 wt %, Cr 0.001 wt %, Pb 0.001 wt %, Sn 0.002 wt %, Ti 0.0147 wt %, etc., was added to the aluminum base alloy. However, the amount of the impurities added to the aluminum base alloy does not influence the present invention.

That is, as shown in FIG. 1, the thermal conductivity of the above aluminum base alloy is as high as 194.35 W/mk. The thermal conductivity thereof is higher than that (192.79 W/mk) of the 6063 which is a commercially available aluminum alloy. The measured thermal conductivity of the 6063 is shown in FIG. 2.

The present invention provides an aluminum base alloy which has high thermal conductivity and can be die-cast. An aluminum base alloy according to another embodiment of the present invention includes Mg 0.2~2.0 wt %, Fe 0.1~0.3 wt %, Co 0.1~1.0 wt %, Ag 0.05~0.3 wt % and residual Al, based on 100% of the total weight thereof.

Ag has a thermal conductivity of 429 W/mk, and is a metal having the highest thermal conductivity. Ag exerts an influence on improving the thermal conductivity of an aluminum base alloy, and is effective in preventing the segregation thereof and improving the fluidity thereof.

An aluminum base alloy according to a further embodiment of the present invention further includes 0.05~0.3 wt % of Ti in addition to the above components. The addition of Ti is helpful to improving injection fluidity and preventing the cracking of a product by the miniaturization of crystal grains.

When magnesium (Mg) is added to an aluminum base alloy, there is an advantage of improving the corrosion resistance and mechanical properties of the aluminum base alloy. However, when magnesium (Mg) is added in an excessive amount of 2 wt % or more, there are advantages that it is difficult to cast the aluminum base alloy because the fluidity of molten alumni alloy decreases and that the toughness and elongation rate of the aluminum base alloy deteriorates. Further, when magnesium (Mg) is added in a small amount of 0.2 wt % or less, no effect is brought about by the addition.

Therefore, in the present invention, magnesium (Mg) is added in an amount of 0.2-2 wt % in consideration of the strength and injectability of the aluminum base alloy.

Cobalt (Co), which is an important component of the aluminum base alloy, improves the colorability of the aluminum base alloy at the time of anodizing the aluminum base alloy, and increase the fluidity thereof, thus enabling the aluminum base alloy to be injected.

The reason for anodizing the aluminum base alloy as surface treatment is because a porous hard film ($Al_2O_3$) improves thermal emissivity and maintains thermal conductivity. Generally, the anodized aluminum base alloy serves as a heat sink to a degree of 10% compared to the aluminum base alloy surface-treated by coating.

As such, when the aluminum base alloy is anodized, the anodized aluminum base alloy can have a beautiful appearance having various colors.

Iron (Fe) is added in small amounts in order to prevent dies from being fusion-bonded at the time of die casting. However, it is preferred that the addition of iron (Fe), if possible, be controlled because it deteriorates the softness and toughness of the aluminum base alloy and forms intermetallic compounds so that the aluminum base alloy becomes brittle. Therefore, in the present invention, the amount of Iron (Fe) added is 0.1~0.3 wt %.

The aluminum base alloy may be used to manufacture products, such as LED and the like, required to rapidly radiate heat using thermal conductivity, and may also used to manufacture products requiring high thermal conductivity.

The compositions of 6063 and ADC12 (Comparative Examples) are as follows.

The 6063 has a composition including Si 0.20~0.6 wt %, Fe 0.35 wt %, Cu 0.1 wt %, Mn 0.1 wt %, Mg 0.45~0.9 wt %, Cr 0.1 wt %, Zn 0.1 wt %, Ti 0.1 wt % and Zr 0.05 wt %, and has a thermal conductivity of 192 W/mk. The thermal conductivity thereof is similar to or lower than that of the aluminum base alloy of the present invention.

ADC12

The ADC12 has a composition including Si 9.8~12.0 wt %, Fe 0.3~0.6 wt %, Cu 1.5~3.5 wt %, Mn 0.5 wt % or less, Mg 0.3 wt % or less and Zn 1.0 wt % or less, and has a thermal conductivity of 100 W/mk.

In the present invention, the experimental values of aluminum base alloys having different compositions in the above composition range are as follows.

When an aluminum base alloy including Mg 0.2 wt %, Fe 0.1 wt, Co 0.1 wt % and residual Al based on 100 wt % of the total weight thereof is formed, the fluidity of the aluminum base alloy decreases, but the thermal conductivity thereof is measured 194.65 W/mk, which is similar to that of the aluminum base alloy of the present invention.

When an aluminum base alloy including Mg 0.2 wt %, Fe 0.1 wt, Co 0.5 wt % and residual Al based on 100 wt % of the total weight thereof is formed, the fluidity of the aluminum base alloy increases, and the thermal conductivity thereof is measured 193.83 W/mk, which is similar to that of the aluminum base alloy of the present invention.

The invention claimed is:

1. A die cast product comprising an aluminum base alloy, the base aluminum alloy consisting of: 0.2 to 2.0 wt % of Mg; 0.1 to 0.3 wt % of Fe; 0.1 to 1.0 wt % of Co; residual Al; and inevitable impurities and having a thermal conductivity of at least 190 W/mk.

2. The die cast product of claim 1 for a die casting application, wherein the die casting application is an LED application.

3. The die cast product of claim 1, wherein the aluminum base alloy is anodized.

* * * * *